United States Patent [19]

Mowatt-Larssen et al.

[11] 3,971,491

[45] July 27, 1976

[54] INTERMODAL TANK CONTAINER

[75] Inventors: Erling Mowatt-Larssen, Warren, Ohio; Thomas S. Lapikas, Sharon, Pa.

[73] Assignee: General American Transportation Corporation, Chicago, Ill.

[22] Filed: Oct. 14, 1975

[21] Appl. No.: 622,253

[52] U.S. Cl. ..... 220/71; 220/1.5; 220/69

[51] Int. Cl.[2] ..... B65D 7/42; B65D 87/00

[58] Field of Search ..... 220/71, 66, 69, 70, 220/72, 1.5, 83, 84

[56] References Cited

UNITED STATES PATENTS

| | | | |
|---|---|---|---|
| 3,814,290 | 6/1974 | Gerhard | 220/1.5 X |
| 3,912,103 | 10/1975 | Gerhard | 220/72 X |

FOREIGN PATENTS OR APPLICATIONS

| | | | |
|---|---|---|---|
| 1,362,461 | 8/1974 | United Kingdom | 220/84 |

*Primary Examiner*—William Price
*Assistant Examiner*—Steven M. Pollard
*Attorney, Agent, or Firm*—Prangley, Dithmar, Vogel, Sandler & Stotland

[57] ABSTRACT

An intermodal tank container for use interchangeably in railroad, highway, marine and terminal modes, including a tank for containing lading and having means for loading lading thereinto and means for unloading lading therefrom, two spaced-apart end frames mounted respectively on the opposite ends of the tank, each end frame including a rigid framework surrounding an area greater than that of the adjacent end of the tank, and a tank support ring surrounding and rigidly secured to the adjacent end of the tank and rigidly secured to the framework for transmitting forces therebetween, the tank comprising the only connection between the end frames and having all parts thereof contained within an envelope defined by the peripheries of the end frames.

15 Claims, 9 Drawing Figures

INTERMODAL TANK CONTAINER

BACKGROUND OF THE INVENTION

The present invention relates generally to improvements in tank containers, and particularly to improvements in tank containers used in several modes of transport including railroad, highway, marine and terminal modes.

Tank containers currently designed for use in intermodal transport have a tank that is completely surrounded by a full structural framework. The structural framework is designed to protect a relatively thin gauge vessel, and to provide a structure that can withstand the forces and shocks encountered in transport and in transfer between one mode of transport and another. Examples of such tank containers are illustrated in U.S. Letters Pat. No. 2,477,831 granted Aug. 2, 1949 to Henry A. Schmitz, Jr. and U.S. Letters Pat. No. 3,616,959 granted Nov. 2, 1971 to Francis Remesy et al.

In yet other prior art structures, various external framing has been utilized, which framing is less than the full framework described above. An example of such a prior art structure is illustrated in U.S. Letters Pat. No. 3,814,290 granted June 4, 1974 to Helmut Gerhard.

SUMMARY OF THE INVENTION

The present invention provides an intermodal tank container for use interchangeably in railroad, highway, marine and terminal modes all without the use of a full framework or truss-type structure, while providing good protection for the tank during all modes of use.

This is accomplished in the present invention, and it is an object of the present invention to accomplish these desired results, by providing an intermodal tank container including a tank for containing lading and having means for loading lading thereinto and means for loading lading therefrom, two spaced-apart end frames mounted respectively on the opposite ends of the tank, each end frame including a rigid framework surrounding an area greater than that of the adjacent end of the tank, and a tank support ring surrounding and rigidly secured to the adjacent end of the tank and rigidly secured to the framework for transmitting forces therebetween, the tank comprising the only connection between the end frames and having all parts thereof contained within an envelope defined by the peripheries of the end frames, whereby the tank is supported by the end frames and protected thereby during all modes of use of the intermodal tank container.

Another object of the invention is to provide an intermodal tank container of the type set forth, wherein the ends of the tank are circular in cross section and the tank support ring is cylindrical in shape to receive the adjacent end of the tank therein.

Yet another object of the invention is to provide an intermodal tank container of the type set forth, wherein the rigid framework is square in shape with the frameworks at the opposite ends of the tank in alignment with each other.

Still another object of the invention is to provide an intermodal tank container of the type set forth, wherein bracing structure is provided between the rigid framework and the body of the tank.

Further features of the invention pertain to the particular arrangement of the parts of the intermodal tank container, whereby the above outlined and additional operating features thereof are attained.

The invention, both as to its organization and method of operation, together with further features and advantages thereof will best be understood with reference to the following specification when taken in connection with the accompanying drawings.

DESCRIPTION OF THE PREFERRED EMBODIMENT

Figure 1:
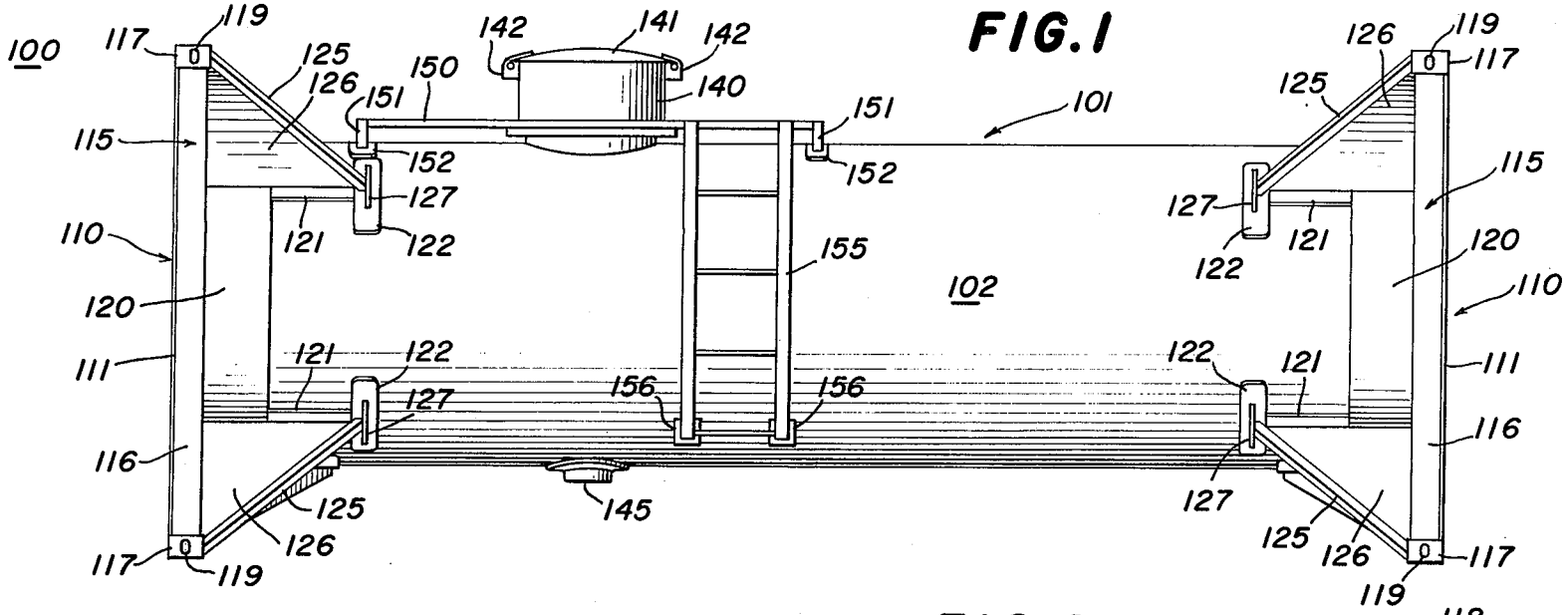
FIG. 1 is a side elevational view of an intermodal tank container made in accordance with an embodying the principles of the present invention.
Figure 2:
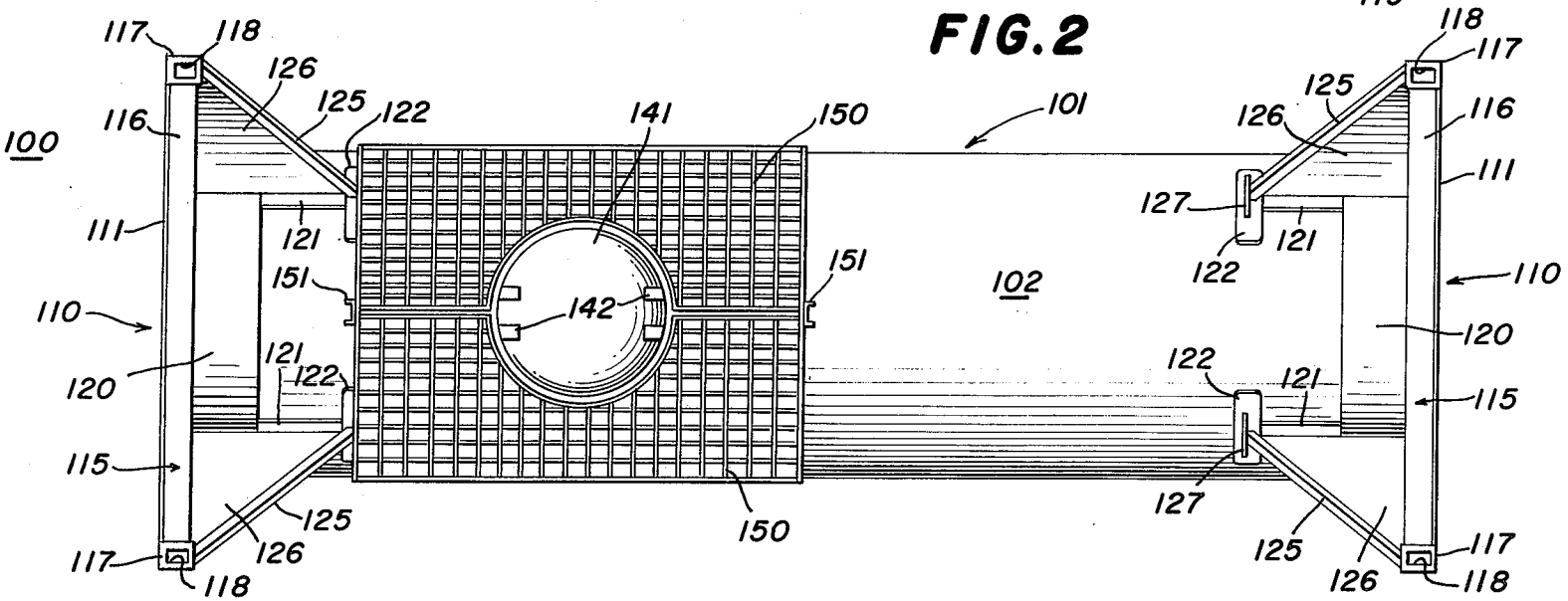
FIG. 2 is a plan view of the container of FIG. 1.

Referring to FIGS. 1 and 2 of the drawings, there is illustrated an intermodal tank container generally designated by the numeral 100 made in accordance with and embodying the principles of the present invention. The container 100 includes a tank 101, a pair of end frames 110 disposed respectively at and affixed to the opposite ends of the tank 101, a manway 140, a grating 150 and a ladder 155.

The tank 101 as illustrated is cylindrical in shape and circular in cross section and may be, for example, approximately 19-½ feet long and 5 feet in diameter with a wall thickness of approximately 3/8 inch when manufactured of steel. It will be appreciated that the tank 101 is a relatively thin-gauge vessel yet because of the unique features of the present invention can withstand the stresses and loads encountered during intermodal transport. It will be appreciated that the tank 101 may have lengths other than 19-½ feet, and may for example, have lengths of 9-½ feet, 29-½ feet or 39-178 feet. -½

The tank 101 is preferably fabricated and includes a cylindrical shell or side wall 102 that is circular in cross section and has a length slightly greater than 17 feet. An ellipsoidal head shell 103 is provided at each end of the cylindrical shell 102 and is fixedly secured thereto in an air-tight and fluid-tight manner by welding at the junctures 104 therebetween. The resultant tank 101 has a smooth inner surface 105 that defines the lading compartment thereof.

Figure 4:
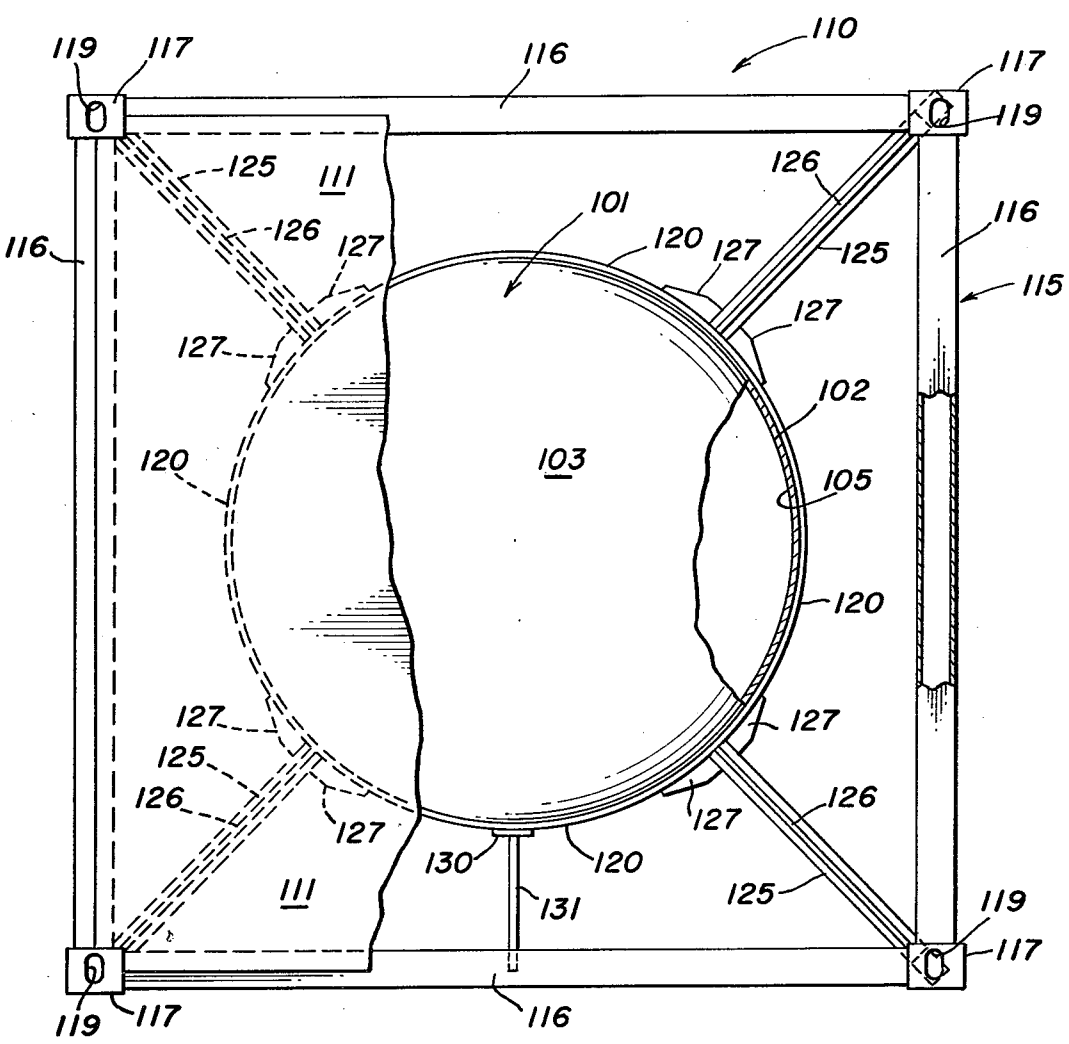
FIG. 4 is an end view with certain parts broken away as seen in the direction of the arrows along the line 4—4 of FIG. 3.

Disposed at each end of the tank 101 is one of end frames 110, the end frames 110 being identical in construction, whereby only one of the end frames 110 will be described in detail. The end frame 110 includes a framework generally designated by the numberal 115 (see FIG. 4 also) the framework 115 being generally square in shape and in one preferred embodiment of the invention having dimensions 8 feet on a side. The framework 115 is made up of four lengths of tubes 116, the tubes being rectangular in cross section and hollow (see the righthand portion of FIG. 4), the ends of the tubes 116 being secured to corner castings 117, any securing method being useful such as welding. The corner castings 117 have openings in the upper and lower sides thereof, as the case may be, that are generally rectangular in shape and designated by the numerals 118. Furthermore, the corner castings 117 have side openings therein that are oval in shape and are designated by the numerals 119. The openings 118 and 119 are useful in handling the container 100, particularly when shifting from one mode of transport to another and for tie down purposes.

Figure 3:
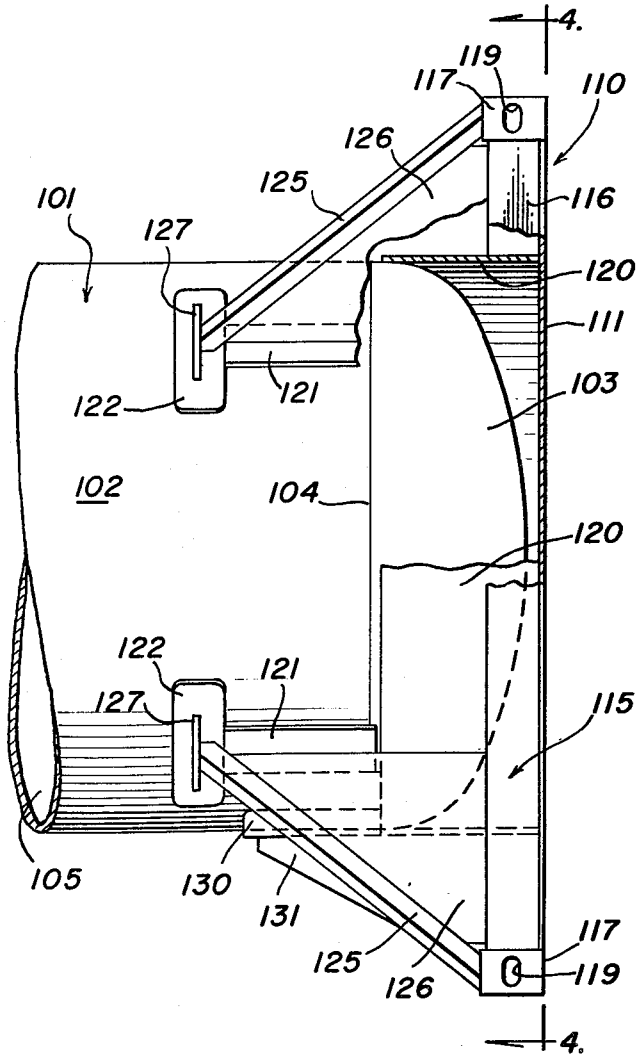
FIG. 3 is an enlarged fragmentary view with certain parts broken away of the right hand end of the tank container of FIG. 1.
Figure 5:
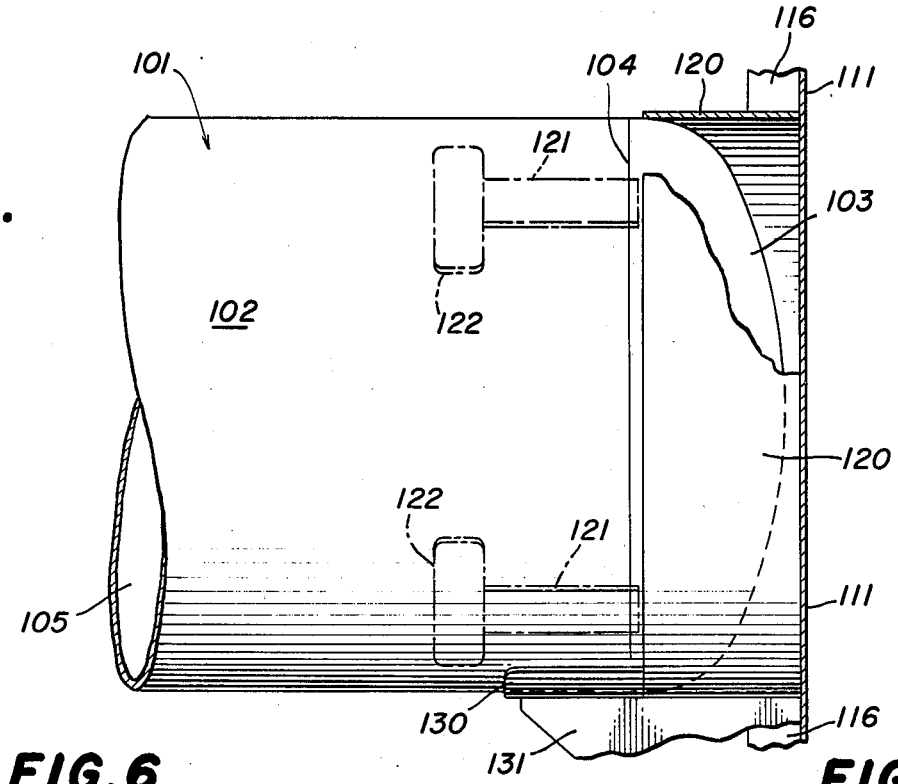
FIG. 5 is a view similar to FIG. 3 with still further portions broken away.

The framework 115 has one side thereof closed by a square end plate or web plate 111 which is fixedly secured to the framework 115 (see FIG. 3 also). Secured to the end plate 111 and extending therefrom towards the adjacent tank end is a cylindrical tank support ring 120, the internal diameter of the tank support ring 120 being such as to receive the adjacent end of the tank 101 thereinto. The tank support ring 120 is rigidly secured to the adjacent end of the tank 101 such as by welding. The support ring 120 provides the fundamental connection between the adjacent end of the tank 101 and the end frame 110 so as to transmit forces therebetween, the forces being uniformly distributed about the circumference of the tank 101 by the tank support ring 120.

In order further to distribute the forces from the end frames 110 about and along the tank 101, and to hold the end frames 110 in the desired position with respect to the tank 101, further bracing is provided by a plurality of diagonal braces 125. More particularly, each of the frameworks 115 is provided with four diagonal braces 125, the braces being arranged in the manner illustrated best in FIG. 4 of the drawings, i.e., the braces 125 being equiangularly arranged and extending radially from the outer surface of the tank 101 to one of the corners or corner castings 117 of the framework 115. Each diagonal brace 125 is formed of a square tube and has one end secured to the associated corner casting 117 and the other end secured to the outer surface of the tank 101, and particularly the adjacent end of the shell 102. In order to distribute the stresses transmitted by the braces 125 over a substantial area of the shell 102, a first longitudinal welding pad 121 is secured thereto and a second circumferentially extending welding pad 122 secured thereto, the two welding pads 121 and 122 forming a T-shaped configuration. There further is provided a longitudinal gusset 126 that essentially fills the space between the end plate 111, the diagonal brace 125, the tank support ring 120 and the longitudinal welding pad 121. There also is provided a bearing piece 127 secured to the circumferentially extending welding pad 122 and abutting against the adjacent end of the diagonal brace 125. All of the parts associated with the diagonal brace 125 are secured together rigidly as by welding. Disposed between the lowermost braces 125 is a longitudinal gusset 131 which is secured to the tank shell 102 by means of a welding pad 130 and is also secured to the tank support ring 120 and the end plate 111, all by welding.

In order to provide access to the interior of the tank 101, a manway 140 is provided therefore, the manway 140 being positioned circumferentially midway between two of the diagonal braces 125. The manway 140 has the usual cover 141 and closure structure 142. Arranged within the manway 140 is suitable lading loading structure and lading unloading structure (not shown). There also is provided at the bottom of the tank 101 a sump 145 useful with the lading unloading structure.

The manway 140 is surrounded by a grating supported by a plurality of posts 151 that are secured to the outer surface of the tank shell 102 by welding pads 152. Access to the grating 150 is provided by a ladder 155 secured at its upper end to the grating 150 and at its lower end to the tank shell 102 by means of welding pads 156. The manway 140, the grating 150 and the ladder 155 all fall within a clearance envelope defined by the peripheries of the frameworks 115, i.e., within a surface defined by the peripheries of the frameworks 115 and extending therebetween.

Figure 6:
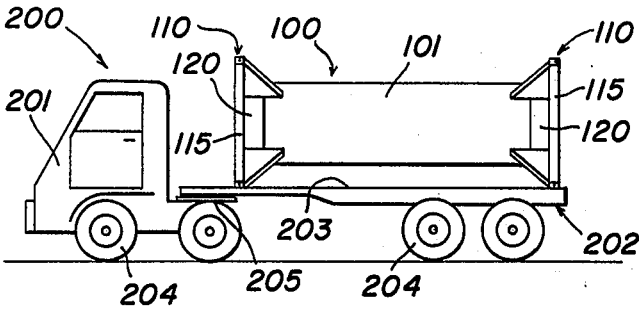
FIGS. 6 to 9 illustrate diagrammatically the use of the container of FIG. 1 in various modes of transport.

Referring to FIG. 6 of the drawings, there is diagrammatically illustrated the use of one of the intermodal tank containers 100 in a typical highway transport situation wherein the container 100 is mounted upon the trailer of a truck 200. The truck 200 includes the usual tractor 201 connected by a hitch 205 to a trailer 202, all supported by road wheels 204. The trailer 202 includes a flatbed 203 upon which the intermodal tank container 100 is disposed. Tie down devices (not shown) may also be provided to secure the end frames 110 to the trailer bed 203 via the corner castings 117.

Figure 7:
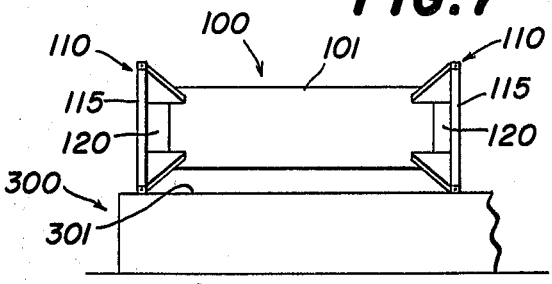

There is illustrated in FIG. 7 a diagrammatic representation of the disposition of one of the intermodal tank containers 100 at a terminal site 300 upon a dock 301. It will be appreciated that it is necessary to handle and move the container 100 between one of the transport modes and the terminal 300, such as by a lifting crane or the like. During such movement, the corner castings 117 provide a ready form of connection of cables and the like for such transfer.

Figure 8:
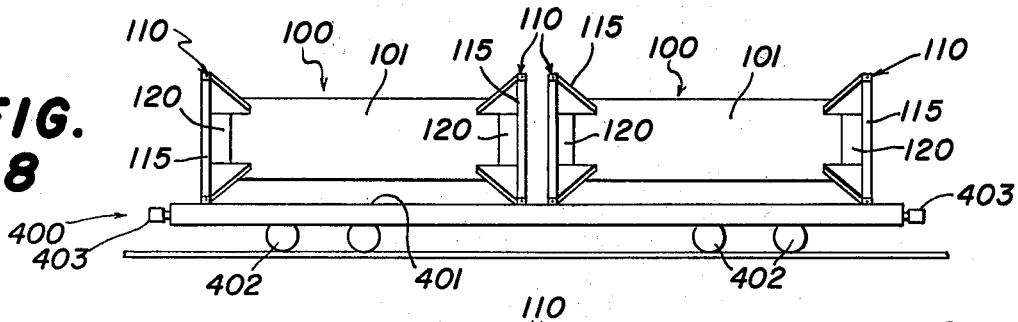

Referring to FIG. 8 there is illustrated the manner in which two of the intermodal tank containers 100 can be conveniently transported in a railroad mode. There is illustrated a railway car 400 having a bed or frame 401 supported upon wheeled trucks 402 and provided at each end with couplers 403 for connection to adjacent cars in a railway train. The intermodal tank containers 100 are illustrated arranged longitudinally with respect to the bed 401 and preferably are secured thereto by tie down devices (not shown) that are suitably secured to the corner castings 117.

Figure 9:
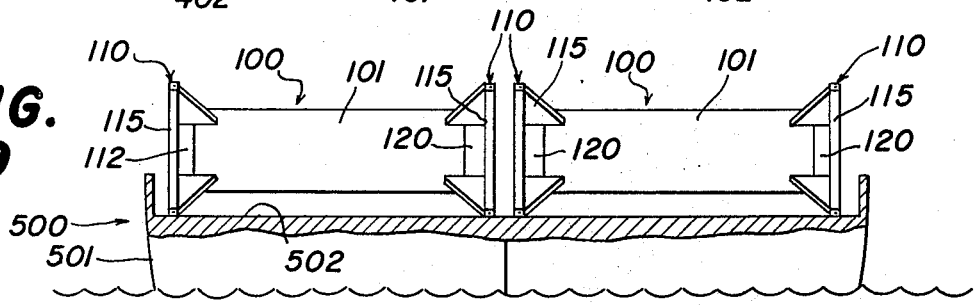

Finally, there is illustrated in FIG. 9 the manner in which a plurality of the intermodal tank containers 100 would be transported in the marine mode. There is shown a cargo ship 500 of the type utilized in transporting containerized lading, the ship 500 including the usual hull 501 and a deck 502. Two of the intermodal tank containers 100 have been shown disposed upon the deck 502 in longitudinal relation with respect to each other and athwart the ship 500. It will be appreciated that the intermodal tank containers 100 are preferably secured to the deck 502 by tie down devices (not shown) acting through the corner castings 117. It further will be appreciated that it is possible to stack the intermodal tank containers 100 one upon another, the end frames 110 being designed and constructed to accommodate such an arrangement.

In all modes of transport of the intermodal tank container 100, all of the forces and shocks encountered are first applied to the end frames 110. The end frames 110 are quite strong including the square framework 115 at each end which is further reinforced by the web plate 111. The forces encountered by the framework 115 are then transmitted to the shell 102 but distributed uniformly therearound whereby to avoid any critical load concentration at any point in the shell 102. The distribution of the load is effected in two ways; first, by the tank support ring 120 that extends completely around the adjacent end shell 103 and is secured thereto completely around the circumference thereof; second, by the four diagonal braces 125 that are connected between the end frame 110 and the shell 102 at points spaced from the tank support ring 120, the connection between the diagonal braces 125 and the shell 102 being spread upon the shell 102 by the use of the welding pads 121 and 122 and the interposition of the longitudinal gusset 126 between the end plate 111, the diagonal brace 125, the tank support ring 120 and the welding pads 121 and 122. Because the forces applied to the shell of the tank 101 are so well distributed about the circumference thereof and along the length thereof, the shell of the tank 101 can be made of relatively light gauge material while maintaining the necessary strength required to withstand the forces encountered during transport. This provides an extremely strong, yet light and economical structure. The strength of the intermodal tank container 100 is concentrated at the ends thereof where the container 100 is most vulnerable to damage from handling in the four modes of transport encountered and in the transfer therebetween.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. An intermodal tank container for use interchangeably in railroad, highway, marine and terminal modes, said container comprising a tank for containing ladings and having means for loading lading thereinto and means for unloading lading therefrom, two spaced-apart end frames mounted respectively on the opposite ends of said tank, each end frame including a rigid framework surrounding an area greater than that of the adjacent end of said tank, and a tank support ring surrounding the adjacent end of said tank and secured thereto around the periphery thereof and rigidly secured to said framework for transmitting forces therebetween, said tank comprising the only connection between said end frames and having all parts thereof contained within an envelope defined by the peripheries of said end frames, whereby said tank is supported by said end frames and protected thereby during all modes of use of said intermodal tank container.

2. The intermodal tank container set forth in claim 1, and further comprising, a manway for said tank providing access to said lading loading means and said lading unloading means.

3. The intermodal tank container set forth in claim 2, and further comprising a grating mounted on said tank and surrounding said manway, and a ladder mounted on said tank and providing access to said grating.

4. The intermodal tank container set forth in claim 1, wherein said end frames are rectangular in configuration and are in angular alignment about the axis of said tank.

5. The intermodal tank container set forth in claim 1, wherein each of said end frames includes an end plate closing said framework, said end plate being secured to and mounting said tank support ring thereon.

6. The intermodal tank container set forth in claim 1, wherein each framework includes corner castings interconnecting tubes, said corner castings having openings therein for use in lifting and transferring said intermodal tank container.

7. An intermodal tank container for use interchangeably in railroad, highway, marine and terminal modes, said container comprising a tank for containing ladings and having means for loading lading thereinto and means for unloading lading therefrom, two spaced-apart end frames mounted respectively on the opposite ends of said tank, each end frame including a rigid framework surrounding an area greater than that of the adjacent end of said tank, a tank support ring surrounding the adjacent end of said tank and secured thereto around the periphery thereof and rigidly secured to said framework for transmitting forces therebetween, a plurality of diagonal braces interconnecting the outer periphery of said framework and said tank for transmitting forces therebetween, said tank comprising the only connection between said end frames and having all parts thereof contained within an envelope defined by the peripheries of said end frames, whereby said tank is supported by said end frames and protected thereby during all modes of use of said intermodal tank container.

8. The intermodal tank container set forth in claim 7, and further comprising welding pads fixedly secured to said tank around the periphery thereof and having the adjacent end of the associated diagonal brace fixedly secured thereto.

9. The intermodal tank container set forth in claim 7, and further comprising longitudinal gussets respectively disposed between each of said diagonal braces and said tank and said framework.

10. The intermodal tank container set forth in claim 7, wherein said framework is rectangular in configuration, and one of said diagonal braces interconnects one of the corners of said framework and said tank.

11. An intermodal tank container for use interchangeably in railroad, highway, marine and terminal modes, said container comprising an elongated tank circular in cross section for containing lading and having means for loading lading thereinto and means for unloading lading therefrom, two spaced-apart end frames mounted respectively on the opposite ends of said tank, each end frame including a rigid essentially square framework surrounding an area greater than that of the adjacent end of said tank, a tank support ring surrounding the adjacent end of said tank and secured thereto and rigidly secured to said framework for transmitting forces therebetween, and a plurality of diagonal braces respectively interconnecting the corners of said framework and said tank at points spaced from said tank support ring, said tank comprising the only connection between said end frames and having all parts thereof contained within an envelope defined by the peripheries of said end frames, whereby said tank is supported by said end frames and protected thereby during all modes of use of said intermodal tank container.

12. The intermodal tank container set forth in claim 11, wherein each of said end frames includes an end plate closing said framework, said end plate being secured to and mounting said tank support ring thereon.

13. The intermodal tank container set forth in claim 11, wherein each framework includes corner castings interconnecting tubes, said corner castings having openings therein for use in lifting and transferring said intermodal tank container.

14. The intermodal tank container set forth in claim 11, and further comprising welding pads fixedly secured to said tank around the periphery thereof and having the adjacent end of the associated diagonal brace fixedly secured thereto.

15. The intermodal tank container set forth in claim 11, and further comprising longitudinal gussets respectively disposed between each of said diagonal braces and said tank and said framework.

* * * * *